United States Patent [19]

LaBate

[11] Patent Number: 4,585,226

[45] Date of Patent: Apr. 29, 1986

[54] RESILIENT DOCUMENT FEEDING MEMBER

[75] Inventor: Joseph LaBate, Bethel, Conn.

[73] Assignee: Pitney Bowes Inc., Stamford, Conn.

[21] Appl. No.: 630,129

[22] Filed: Jul. 12, 1984

[51] Int. Cl.[4] ..... B65H 5/06; B65H 3/06

[52] U.S. Cl. ..... 271/264; 51/334; 198/722; 221/259; 271/120; 414/123

[58] Field of Search ..... 271/119, 120, 109, 314, 271/264, 275; 414/123, 129, 36; 198/722; 279/1 Q; 403/354, 346; 51/334, 335, 336, 337; 221/259, 260; 29/120, 121.1, 121.6, 121.7

[56] References Cited

U.S. PATENT DOCUMENTS 1,118,153 11/1914 Sanborn ..... 51/336
1,626,386 4/1927 Bronander ..... 271/119
2,440,856 5/1948 Harrison ..... 51/337
4,381,860 5/1983 Silverberg ..... 271/120 X

*Primary Examiner*—Bruce H. Stoner, Jr.
*Assistant Examiner*—M. C. Graham
*Attorney, Agent, or Firm*—Lawrence E. Sklar; William D. Soltow, Jr.; Albert W. Scribner

[57] ABSTRACT

A resilient document feeding member having a drive shaft, and a double D hub fixedly secured to the drive shaft, the double D hub having a pair of opposing flat surfaces. The resilient document feeding member also includes a second hub removably and rotatably mounted on the double D hub, the second hub having a pair of parallel slots which, together with the opposing flat surfaces, define a straight channel, and a pair of resilient arbor flaps, each of the flaps being mounted in one of the channels to thereby frictionally lock the second hub to the double D hub and facilitate quick changing of the arbor flaps.

4 Claims, 10 Drawing Figures

Fig. 1.
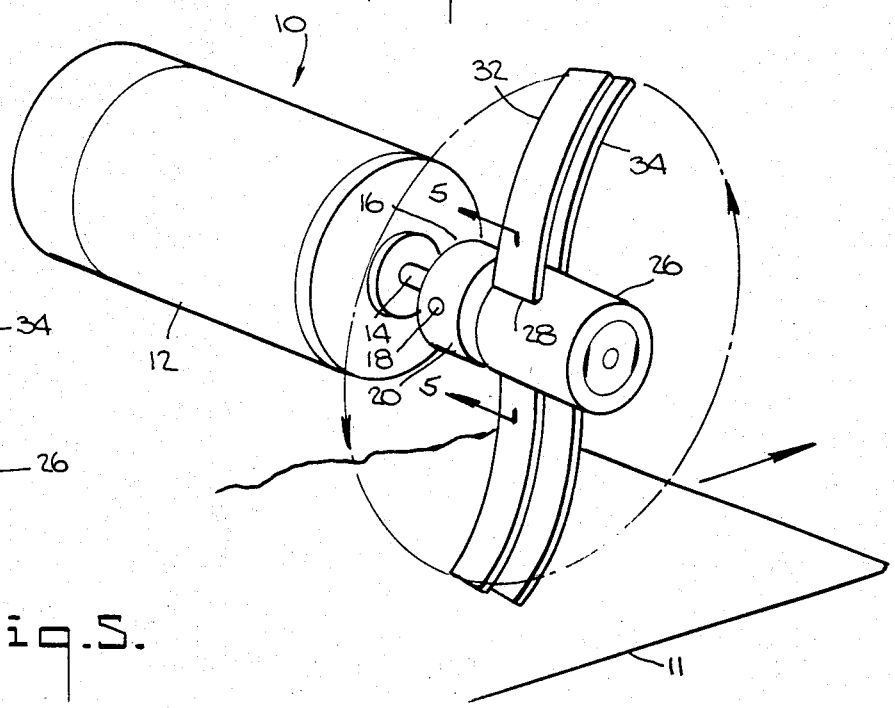
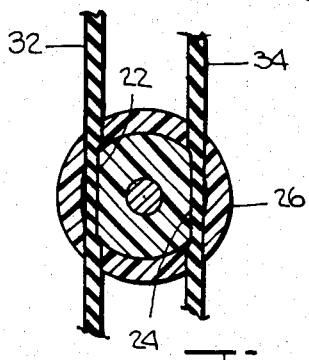
Fig. 5.
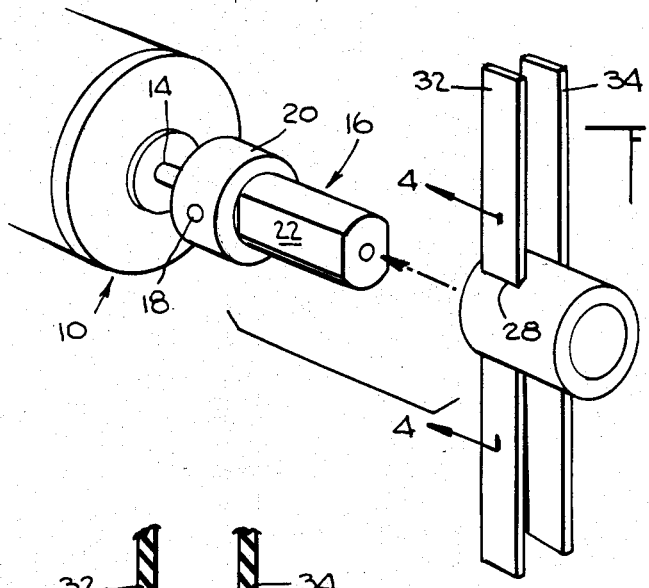
Fig. 2.
Fig. 3.
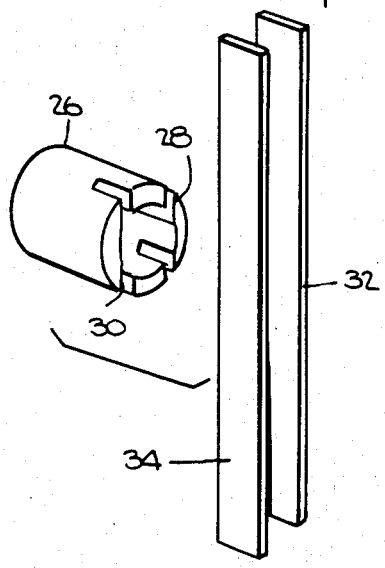
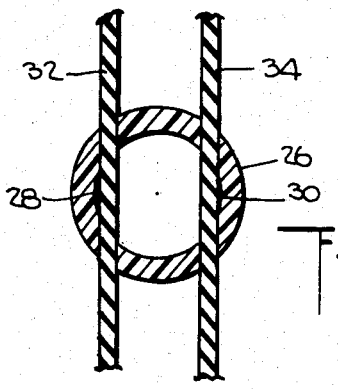
Fig. 4.

Fig. 6.
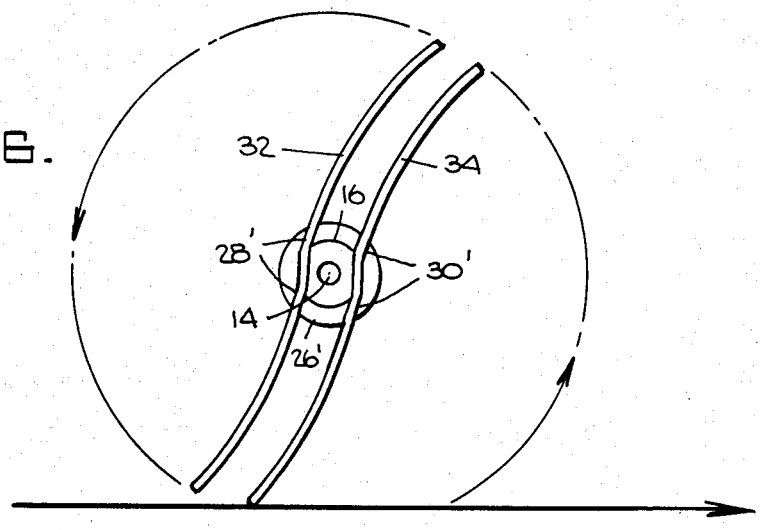
Fig. 7.
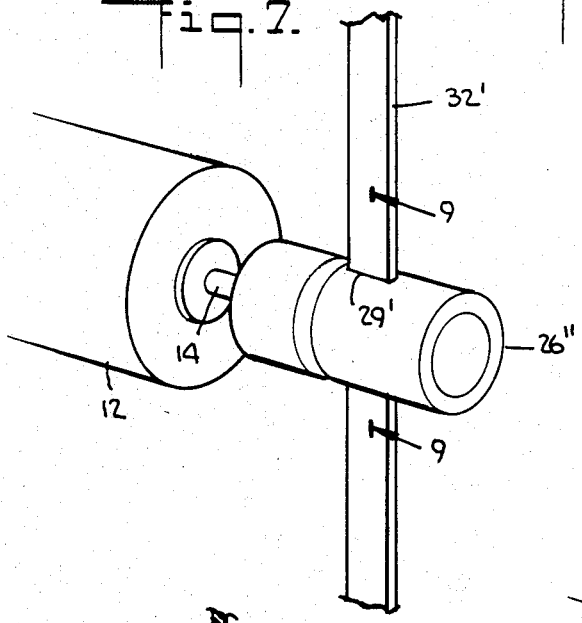
Fig. 10.
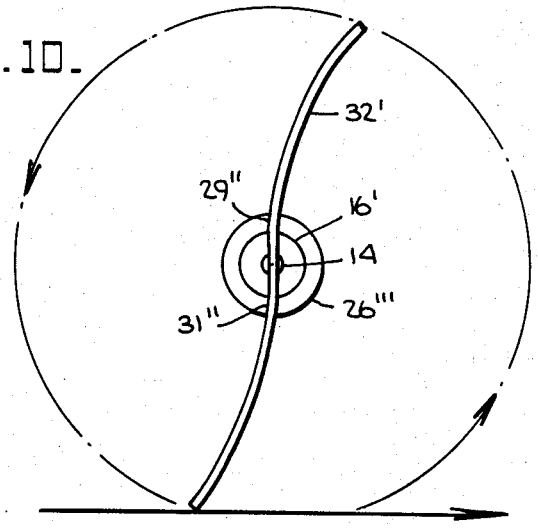
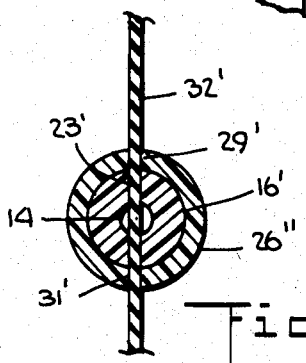
Fig. 9.
Fig. 8.
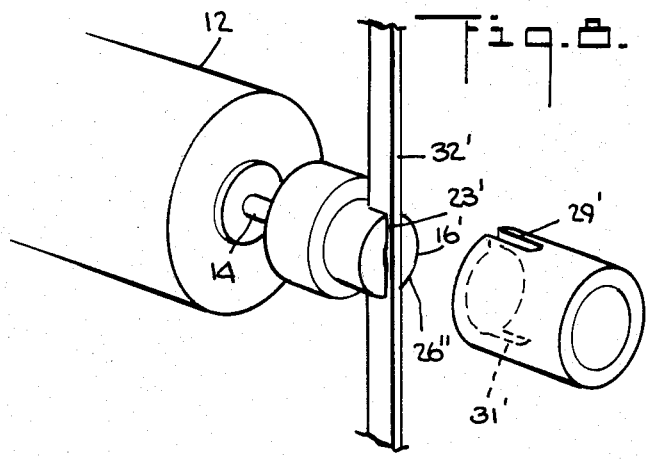

RESILIENT DOCUMENT FEEDING MEMBER

BACKGROUND OF THE INVENTION

The instant invention relates to a document feeder and, more particularly, to a document feeding member having resilient arbor flaps which require periodic replacement.

Certain kinds of document feeders employ resilient arbor flaps to move documents, particularly single sheets of paper, in a particular, desired direction. Because these arbor flaps wear out after a period of time, periodic replacement is required. In virtually all document feeders used today, a slotted metal hub is used to hold the arbor flaps. When it is necessary to replace the arbor flaps, an operator must use a screwdriver or wrench to remove and replace the set screws which secure the flaps. This is a time consuming process which can contribute to a significant amount of down time for a document feeder having resilient arbor flaps.

The foregoing problems inherent in changing resilient arbor flaps in document feeders are overcome by the instant invention which provides a resilient document feeding member having a design which permits the resilient arbor flaps to be changed without the need for any tools. Using the instant invention, an operator would be able to effect the changing of the arbor flaps in a couple of seconds, a dramatic decrease from the several minutes now required to change the arbor flaps in conventional resilient document feeding members.

SUMMARY OF THE INVENTION

Accordingly, the instant invention provides a resilient document feeding member having a drive shaft, and a double D hub fixedly secured to the drive shaft, the double D hub having a pair of opposing flat surfaces. The resilient document feeding member also includes a second hub removably and rotatably mounted on the double D hub, the second hub having a pair of parallel slots which, together with the opposing flat surfaces when the second hub is mounted on the double D hub with the slots parallel to the opposing flat surfaces, define a straight channel, and a pair of resilient arbor flaps, each of the flaps being mounted in one of the channels to thereby frictionally lock the second hub to the double D hub.

An alternative embodiment of the instant invention provides a resilient document feeding member having a drive shaft and a first hub fixedly secured to the drive shaft, the first hub having a median slot extending across the outer end thereof. The resilient document feeding member also includes a second hub removably and rotatably mounted on the first hub, the second hub having a pair of diametrically aligned slots which, together with the median slot, when the second hub is mounted on the first hub with the median slot aligned with the diametrically aligned slots, define a straight channel, and a resilient arbor flap mounted in the straight channel to thereby frictionally lock the second hub to the first hub.

BRIEF DESCRIPTION OF THE DRAWINGS

FIG. 1 is a perspective view of a resilient document feeding member in accordance with the instant invention;

FIG. 2 is similar to FIG. 1, but it shows the resilient arbor flaps and hub in which they are mounted separated from the document feeding member;

FIG. 3 is a perspective view showing the arbor flaps removed from the hub in which they are mounted;

FIG. 4 is a sectional view taken on the vertical plane indicated by the line 4—4 in FIG. 2;

FIG. 5 is a sectional view taken on the vertical plane indicated by the line 5—5 in FIG. 1;

FIG. 6 is an end view of an alternative embodiment of the instant invention, similar to the embodiment seen in FIGS. 1–5 but with the slots in the exterior hub in which the arbor flaps are mounted being angled;

FIG. 7 is a perspective view of a third embodiment of the instant invention using only a single resilient arbor flap;

FIG. 8 is similar to FIG. 7, but it shows the exterior hub separated from the arbor flap and interior hub;

FIG. 9 is a sectional view taken on the vertical plane indicated by the line 9—9 in FIG. 7;

FIG. 10 is an end view of a fourth embodiment of the instant invention similar to the third embodiment seen in FIGS. 7–9 but with the slots in the exterior hub being angled.

DETAILED DESCRIPTION

In describing the instant invention, reference is made to the drawings, wherein there is seen a resilient document feeding member generally designated 10 which is employed in a document feeder (not shown) to feed documents, such as an envelope 11, in a particular direction as indicated by the arrow. The document feeding member 10 includes a motor 12 in which a drive shaft 14 is journaled. A double D hub 16 is fixedly mounted on the drive shaft 14 by means of a set screw 18 and includes a cylindrical base portion 20 and a pair of opposing flat surfaces 22 and 24 (see FIGS. 2 and 5). A second hub 26 is removably and rotatably mounted on the double D hub 16. The second hub 26 includes a pair of parallel slots 28 and 30 extending from one end of the second hub 26 about one half its length. Mounted in each of the slots 28 and 30 (see FIG. 2) are a pair of resilient arbor flaps 32 and 34 respectively. The second hub 26, with the arbors 32 and 34 in place in their respective slots 28 and 30, is mounted on the double D hub 16 by aligning the flaps 32 and 34 with the opposing flat surfaces 22 and 24 in order that the double D hub 16 can receive the second hub 26 and thereby frictionally lock the second hub 26 to the double D hub 16.

When it is desired to change the arbor flaps 32 and 34, for any reason, the operator simply pulls the second hub 26 away from and off the double D hub 16. The old arbor flaps 32 and 34 can then be easily removed from the parallel slots 28 and 30 respectively, and new arbor flaps 32 and 34 dropped into the slots 28 and 30 respectively, in their place. The second hub 26 is then mounted on the double D hub 16 with slots 28 and 30 parallel to the opposing flat surfaces 22 and 24 respectively. The second hub 26 is thereby frictionally locked to the double D hub 16, thereby in turn locking in place the arbor flaps 32 and 34.

It is also possible to mount the second hub 26 onto the double D hub 16 in the opposite direction from what is shown in the drawings, i.e. the slots 28 and 30 would be remote from the base portion 20 of the double D hub 16. Removal of the second hub 26 from the double D hub 16 and of the arbors 32 and 34 from the slots 28 and 30 are accomplished as described above. However, instead of first inserting the arbor flaps 32 and 34 in the slots 28 and 30, the second hub 26 is first mounted onto the double D hub 16 with the slots 28 and 30 aligned parallel to the flat surfaces 22 and 24, thereby defining channels into which the arbor flaps 32 and 34 can fit. Since the arbor flaps 32 and 34 are flexible, e.g. rubber, it is easiest to stretch the flaps 32 and 34 longitudinally, thereby decreasing the thickness of the flaps 32 and 34 to facilitate their placement in the channels. Once in plate, termination of the stretching results in the flaps 32 and 34 frictionally engaging the double D hub 16 and the second hub 26 and locking them together with the flaps 32 and 34.

It may be desirable in using the embodiment shown in FIGS. 1–5 to angle the slots 28' and 30' in the direction in which the flaps 32 and 34 are biased by the rotation of the hub 26'. It should be noted that in FIG. 6 the second hub 26' is mounted in the direction opposite to the mounting of the second hub 26 seen in FIGS. 1–5, i.e. the flaps 32 and 34 are remote from the base portion 20 of the double D hub 16, as discussed hereinabove.

In FIG. 7 is seen a third embodiment in which a single resilient arbor flap 32' is used with a central hub 16' having a median slot 23'. The outer hub 26'' includes a pair of diametrically aligned slots 29' and 31'.

FIG. 10 shows a fourth embodiment of the instant invention, which is a modification of the third embodiment seen in FIGS. 7–9 having a single arbor flap 32'. The outer hub 26''' includes angled slots 29'' and 31'' for the same reason discussed with reference to the embodiment seen in FIG. 6.

The various hubs described hereinabove can be formed from a variety of metals or plastics, but for cost reduction purposes plastics are considered the preferred materials.

The exemplary embodiments described herein are presently considered to be preferred, however, it is contemplated that further variations and modifications within the purview of those skilled in the art can be made herein. The following claims are intended to cover all such variations and modifications as fall within the true spirit and scope of the invention.

What is claimed is:

1. A resilient document feeding member, comprising:

a drive shaft;

a first hub fixedly secured to said drive shaft, said first hub having a pair of opposing flat surfaces;

a second hub fixably mountable to said first hub, for rotation therewith, said second hub having a pair of parallel slots which, together with said opposing flat surfaces when said second hub is mounted on said first hub with said slots parallel to said opposing flat surfaces define a pair of straight channels; and a pair of resilient arbor flaps, each of said flaps being mounted in one of said straight channels to thereby frictionally lock the second hub to the first hub, whereby changing of said flaps requires only pulling said second hub away from said first hub and re-mounting said second hub on said first hub without the use of any tools.

2. The document feeding member of claim 1, wherein said pair of parallel slots are angled with respect to said flat surfaces on said first hub.

3. A resilient document feeding member, comprising:

a drive shaft;

a first hub fixedly secured to said drive shaft, said first hub,having a median slot-extending across the outer end thereof;

a second hub fixably mountable to said first hub for rotation therewith, said second hub having a pair of diametrically aligned slots which, together with said median slot when said second hub is mounted on said first hub with said median slot aligned with said diametrically aligned slots, define a straight channel; and a resilient arbor flap mounted in said straight channel to thereby frictionally lock the second hub to the first hub whereby changing said flap requires only pulling said second hub away from said first hub and re-mounting said second hub on said first hub without the use of any tools.

4. The document feeding member of claim 3, wherein said diametrically aligned slots are angled with respect to said median slot in said first hub.

* * * * *